US011407569B2

(12) United States Patent
Haba et al.

(10) Patent No.: US 11,407,569 B2
(45) Date of Patent: Aug. 9, 2022

(54) SAFETY PACKAGING CHANNEL

(71) Applicant: Telling Industries, LLC, Willoughby, OH (US)

(72) Inventors: Charles Andrew Haba, Kirtland, OH (US); William J. Gibbs, Byesville, OH (US); Stephen Charles Linch, Painesville, OH (US)

(73) Assignee: Telling Industries, LLC, Willoughby, OH (US)

( * ) Notice: Subject to any disclaimer, the term of this patent is extended or adjusted under 35 U.S.C. 154(b) by 278 days.

(21) Appl. No.: 16/708,484

(22) Filed: Dec. 10, 2019

(65) Prior Publication Data

US 2020/0108985 A1 Apr. 9, 2020

Related U.S. Application Data

(60) Provisional application No. 62/778,952, filed on Dec. 13, 2018.

(51) Int. Cl.
*B65D 61/00* (2006.01)
*B65D 63/00* (2006.01)

(52) U.S. Cl.
CPC ..... *B65D 61/00* (2013.01); *B65D 63/00* (2013.01)

(58) Field of Classification Search
CPC .... B65D 61/00; B65D 71/00; B65D 2571/00; B65D 63/00; B65D 2571/00111; B65D 2571/00117; B65D 85/62; B65D 85/46; B65D 63/02; B65D 63/04; B65D 85/20
USPC ..... 206/321
See application file for complete search history.

(56) References Cited

FOREIGN PATENT DOCUMENTS

DE 2731781 A1 * 1/1979 ..... B65D 71/00

* cited by examiner

*Primary Examiner* — Anthony D Stashick
*Assistant Examiner* — L Kmet
(74) *Attorney, Agent, or Firm* — Edwin A. Sisson, Attorney at Law, LLC; Edwin A. Sisson; Jeffrey J. Banyas

(57) ABSTRACT

A packaged bundle using a special designed packaging channel for dunnage is disclosed. The packaging channel dunnage has a channel with hemmed edges and swedged ends exhibiting a two-curved profile to provide a more secure bundle and improved safety during transport and handling.

12 Claims, 13 Drawing Sheets

SAFETY PACKAGING CHANNEL

CROSS REFERENCES AND PRIORITIES

This application claims the benefit of priority of United States Provisional Patent Application No. 62/778,952, filed on 13 Dec. 2018; the teachings of which are incorporated by reference herein in their entirety.

BACKGROUND

As shown in FIGS. 1A-1C, the traditional dunnage for packaging and holding studs and other elongated bundles (100) of similar parts is to place wooden channels (300) on each side of the bundle and bind the bundle with a strap or band (200) placed in the channel (310).

The problems associated with the traditional method are legion. The wood often breaks during transit causing the bundles to shift and become unstable. These breaks are often caused by inferior wood, elements striking the wood, and tightening warped wooden channels too tight.

As shown in FIG. 2, there is an inherent instability using breakable wood.

Wood is also difficult to handle as it leaves splinters in the operators' hands.

Wood dunnage is prone to twisting, warping, bowing, splitting, and cracking. Wood dunnage is also susceptible to insect infestation which can spread to the product the dunnage is protecting. Wood is inherently flammable unless treated.

There exists therefore a need for a better channel system for dunnage and shipping.

SUMMARY

This invention is to a packaged bundle of parts and the metal packaging channel enabling the bundle to remain strong. The packaged bundle of parts comprises a configuration of a plurality of parts.

The configuration of parts can have two ends with at least three configuration sides forming a configuration perimeter perpendicular to a length of the configuration.

The packaged bundle will further comprise at least two metal packaging channels with each packaging channel having a front side, a back side, and a length running from a first packaging channel end and a second packaging channel end.

The packaging channels will each have a channel open on the front side of the packaging channel running the length of the packaging channel.

The channel is located between a first rolled hem flange and second rolled hem edge which is opposite the first rolled hem flange of the metal packaging channel.

The packaging channel will have two ends, with the first packaging channel end having a first swedge, the second packaging channel end having a second swedge.

The back side of each metal packaging channel is placed against a corresponding configuration side with a band passing around the configuration perimeter and in the each channel of the at least two metal packaging channel.

The packaging channel can be more specifically described as having a length running from a packaging channel first end to a packaging second channel end (530), a channel (515) formed by a web (510), a first flange (516) and a second flange (517); and at least a first flange rolled hem (550).

The specification further discloses that the packaging channel have a first end swedge having a first end first profile and a first end second profile, with the first end first profile starting from the center of the web and tracing along the web, reaching an inward curve, which curves into the channel, and then an outward curve which curves away from the channel to an end of the first flange; and with the first end second profile starting from the center of the web and tracing along the web in a direction opposite of the first end first profile, reaching an inward curve, which curves into the channel and then an outward curve which curves away from the channel to an end of the second flange.

It is further disclosed that the width of the packaging channel at the first end swedge can be substantially the same, if not the same, as the width of the packaging channel at a location without the swedge.

The packaging channel may further comprising a second flange rolled hem

It is also disclosed that the profile may extent to just the rolled hems.

The packaging channel of claim 2, wherein the packaging channel is arced along the web for at least a portion of the length.

It is also disclosed that the packaging channel may be arced along the web for at least a portion of the length.

The packaging channel of claim 4, wherein the packaging channel is arced along the web for at least a portion of the length.

The specification also discloses that packaging channel may have at least one bend in the web.

DETAILED DESCRIPTION

Disclosed herein is the inventors' specially designed packaging channel along with its use in a packaged bundle of parts.

As described herein and in the claims, the following numbers refer to the following structures as noted in the Figures.

100 is the bundle of parts to be shipped.
110 is the plurality of parts.
200 is the strap or band.
210 is the strap or band running through the channel.
300 is the prior art wood packaging channel.
310 is the channel in the wood.
320 is the first end of the wood channel.
400 is the failure points and shifting of a bundle in the prior art.
410 is the damage caused when the prior art packaging channel fails.
500 is the packaging channel.
510 is the channel of the packaging channel.
515 is the web of the channel of the packaging channel.
516 is the first flange of the channel of the packaging channel.
517 is the second flange of the channel of the packaging channel.
520 is the first end of the packaging channel.
525 is the swedge of the first end.
526 is the right side profile of the first end when viewed with the channel facing up.
526A is the first curve of the right side profile of the first end when viewed with the channel facing up.
526B is the second curve of the right side profile of the first end when viewed with the channel facing up.
527 is the left side profile of the first end when viewed with the channel facing up.
527A is the first curve of the left side profile of the first end when viewed with the channel facing up.
527B is the second curve of the left side profile of the first end when viewed with the channel facing up.
530 is the second end of the packaging channel.
535 is the swedge of the second end.
540 is the length of the packaging channel.
550 is the second flange rolled hem.
560 is the first flange rolled hem.

This invention is to a packaged bundle of parts as they would be placed, for example, upon a truck for safe shipping, and to the packaging channel used to package the bundle.

Figure 1A:
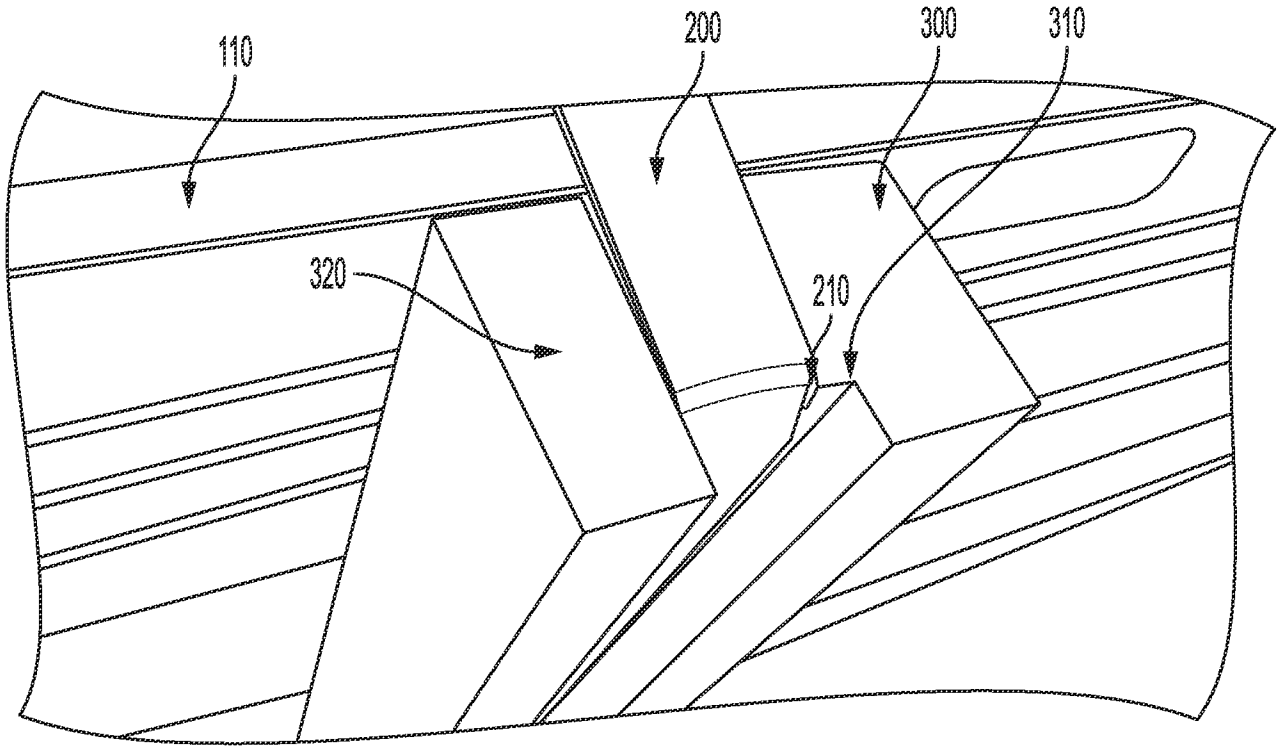
FIG. 1A PRIOR ART
FIG. 1A depicts an enlarged view of a prior art dunnage.
Figure 1B:
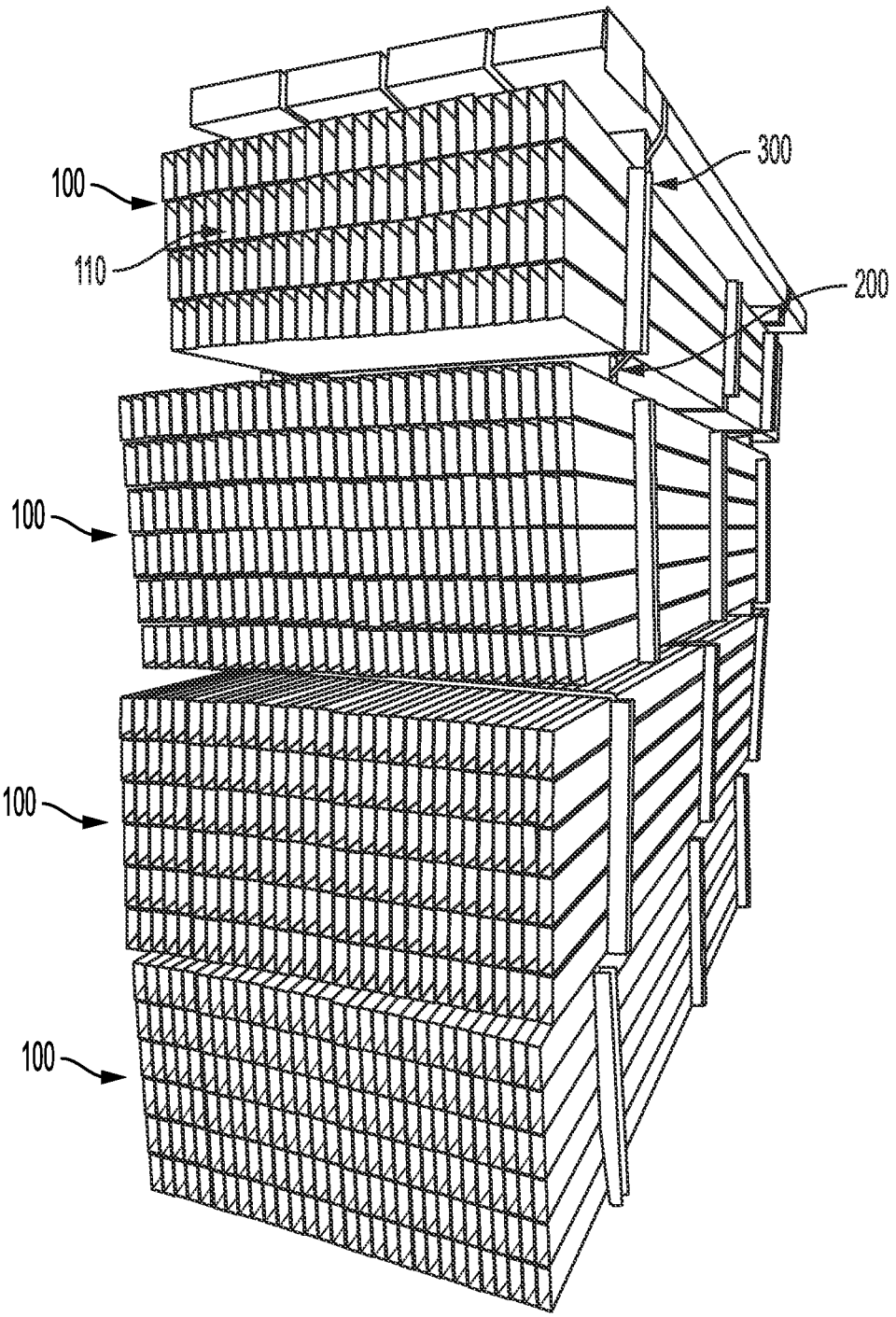
FIG. 1B PRIOR ART
FIG. 1B depicts a perspective view of a prior art dunnage.
Figure 1C:
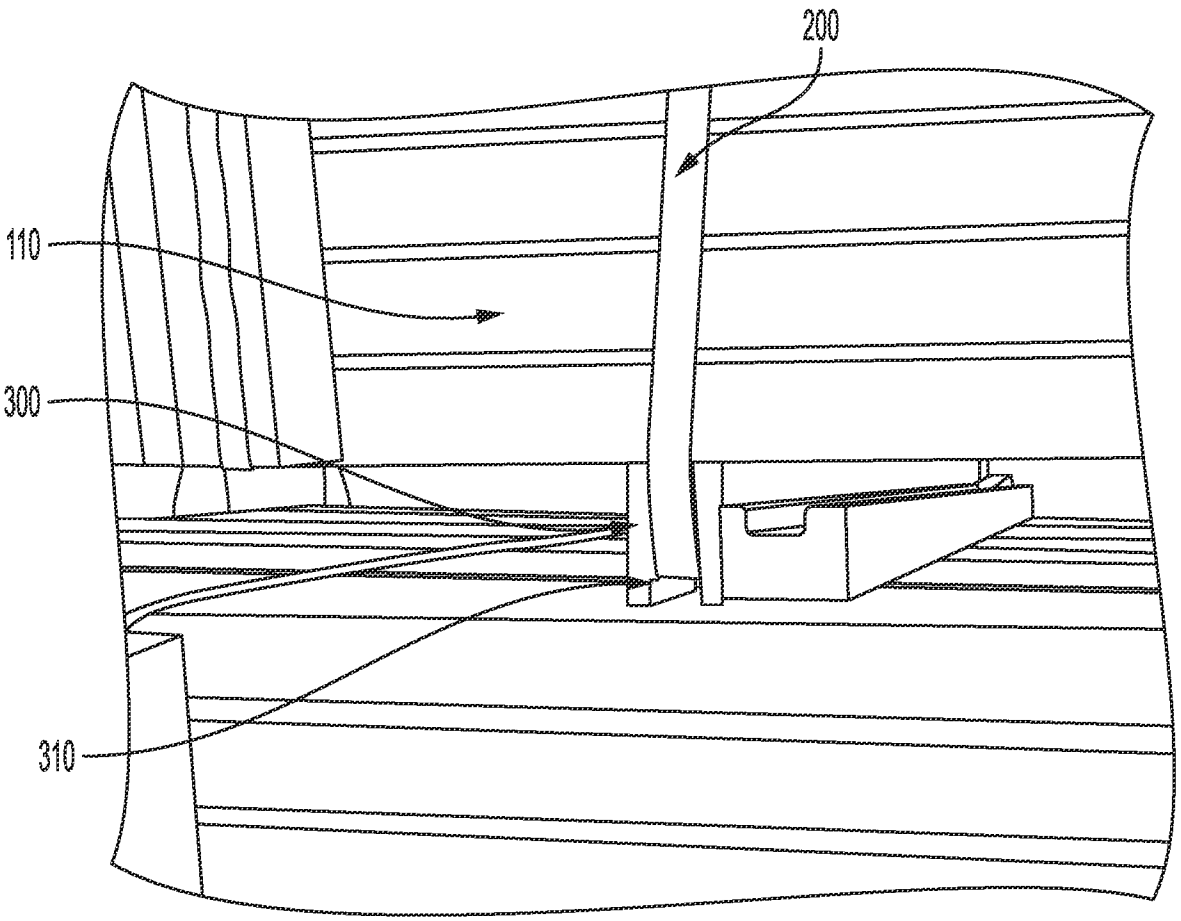
FIG. 1C PRIOR ART
FIG. 1C depicts an alternative enlarged view of a prior art dunnage.
Figure 2:
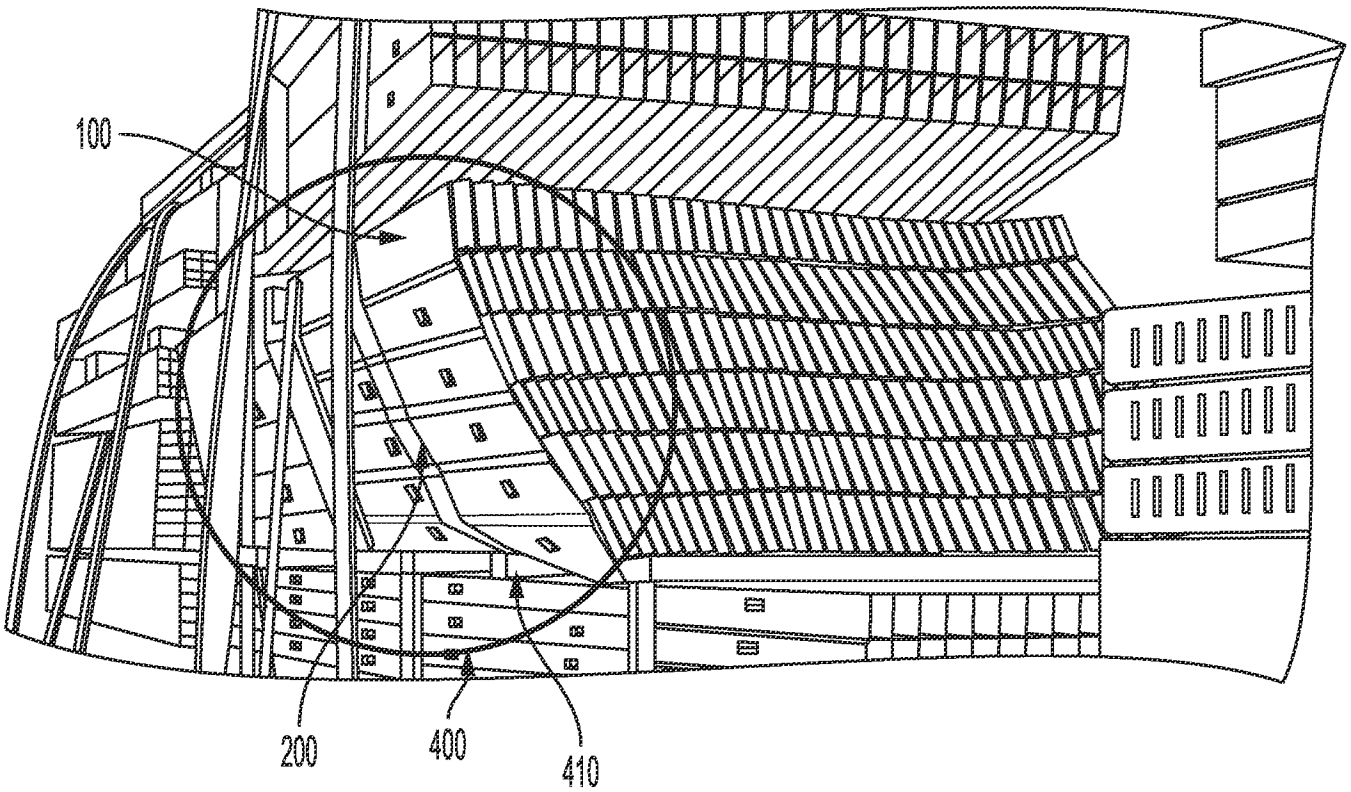
FIG. 2 PRIOR ART
FIG. 2 depicts an alternative perspective view of a prior art dunnage.
Figure 3:
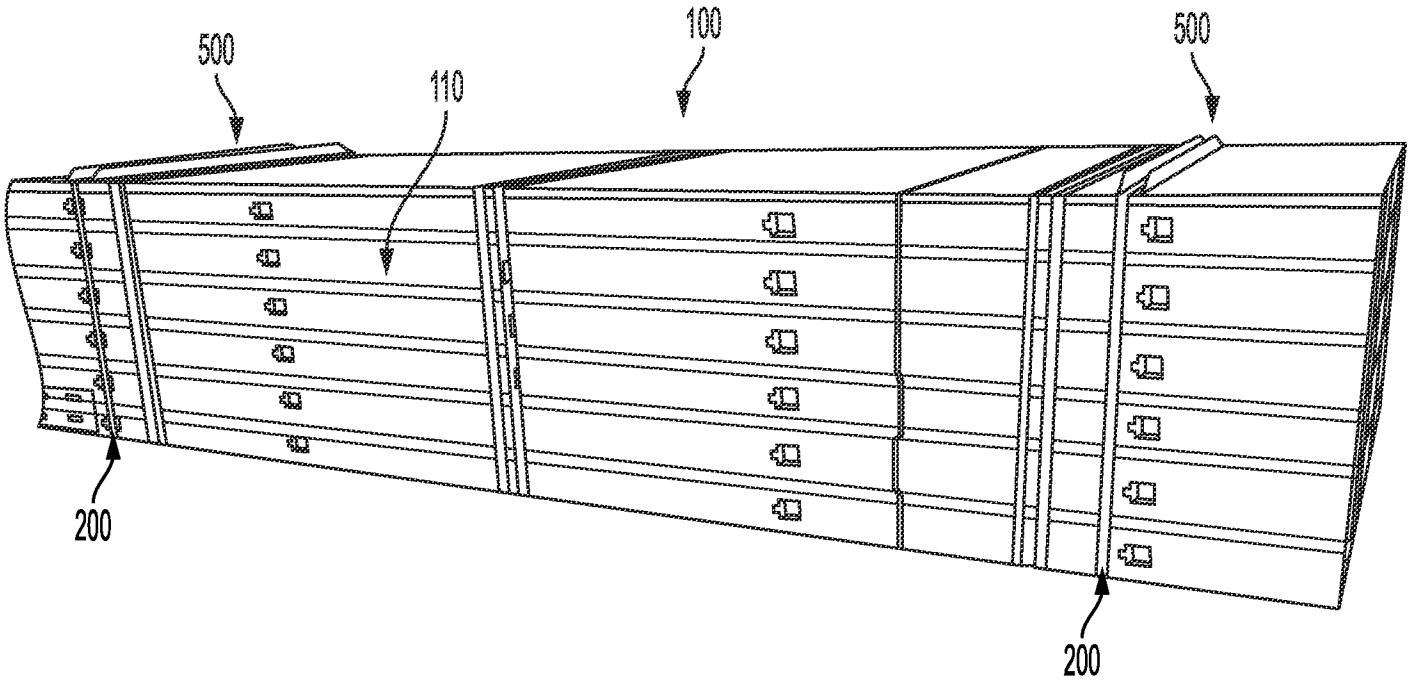
FIG. 3 depicts an embodiment of the invented bundle and the invented packaging channel.
Figure 4:
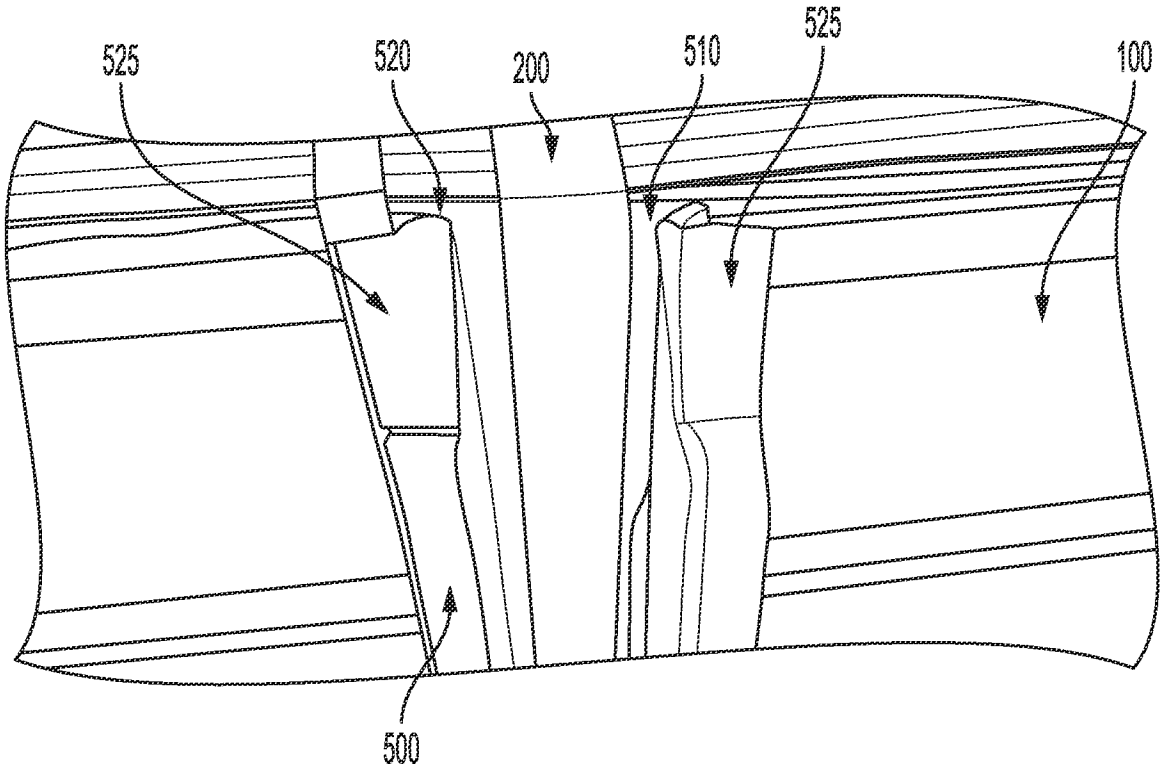
FIG. 4 is an enlarged view of the three components of an embodiment of the invented bundle interacting in their assembled state.
Figure 5:
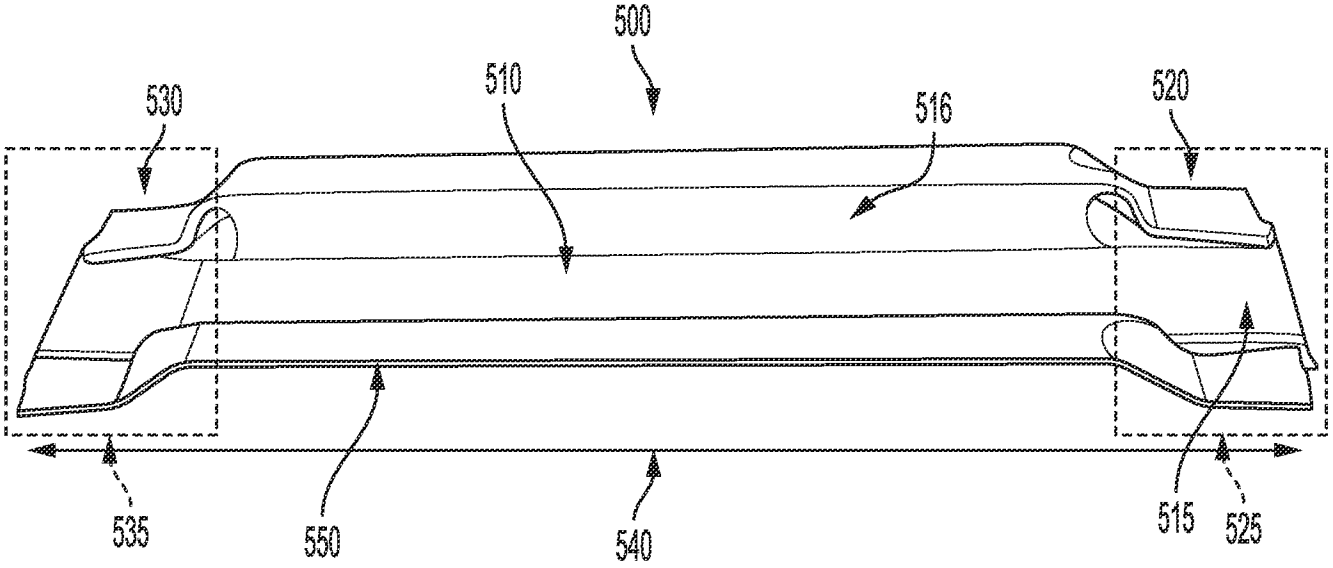
FIG. 5 is a perspective view of one embodiment of the invented packaging channel.
Figure 6:
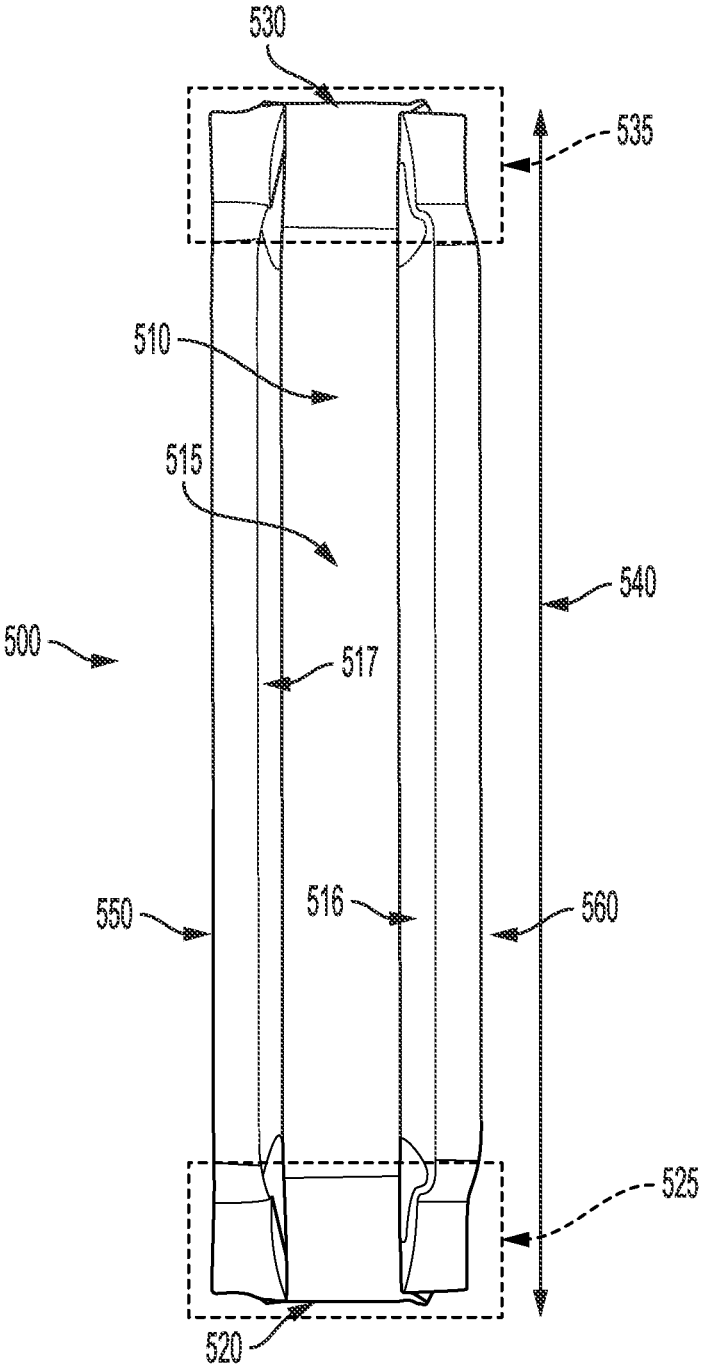
FIG. 6 is a top view of an embodiment of the invented packaging channel.
Figure 7:
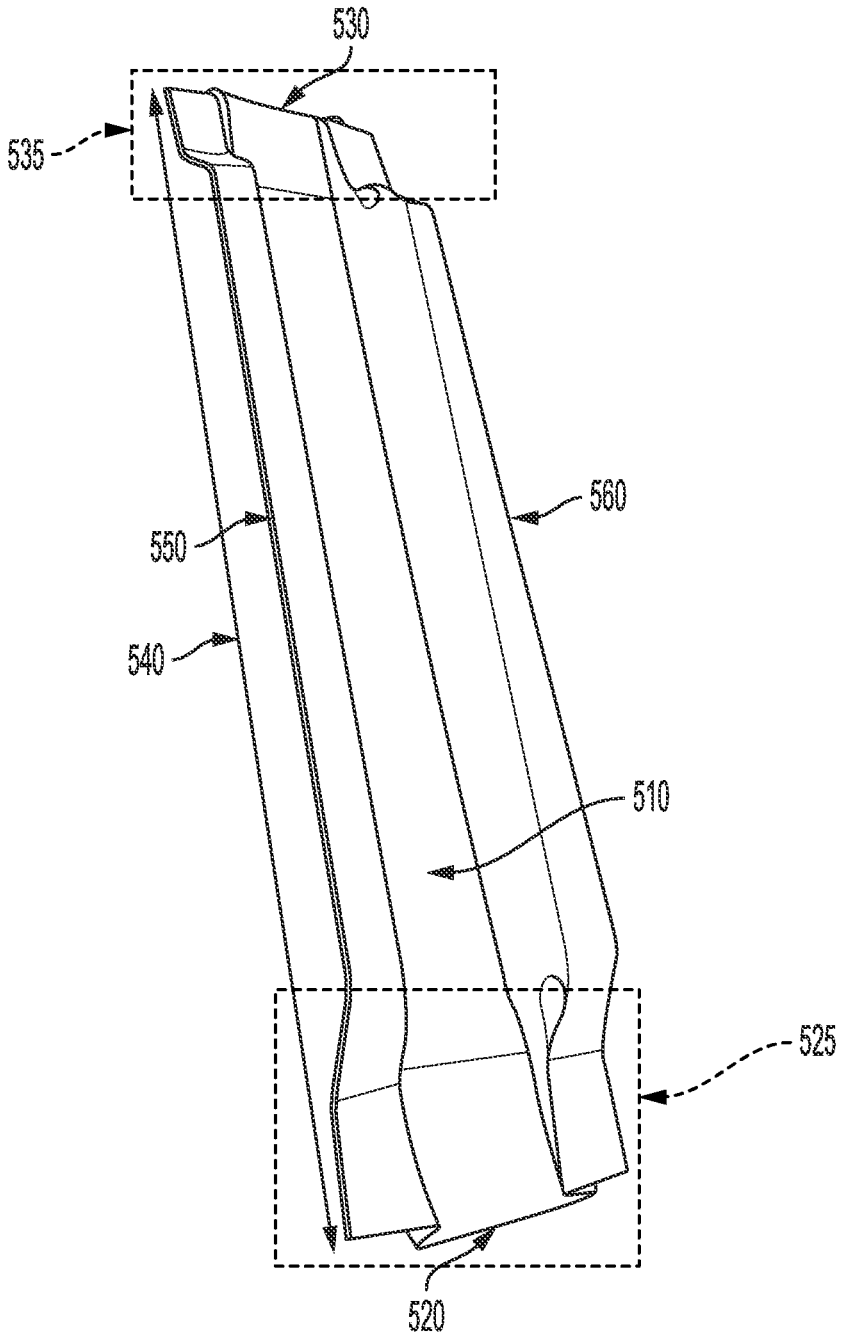
FIG. 7 is an alternative perspective view of an embodiment of the invented packaging channel.
Figure 8:
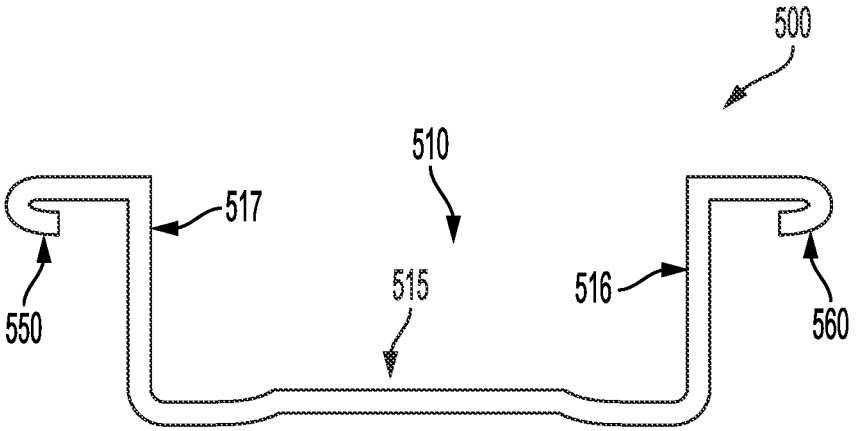
FIG. 8 is a cross sectional view of an embodiment of the invented packaging channel at a swedged end.

The packaged bundle (100) will comprise a configuration of a plurality of parts (110). Usually these parts are of the same dimensions and are configured, or stacked, so that the configuration forms the shape of a triangle or rectangle, where a square is a special type of rectangle. Accordingly, the configuration may have at least three configuration sides forming a configuration perimeter. The special case of circle, such as a large pipe may only have one part and one side. The configuration perimeter will be perpendicular to a length of the configuration with the length having a first end and second end opposite the first end. As seen in FIG. 3, the configuration of the plurality of parts (metal framing studs in this case) is a rectangle.

Figure 10:
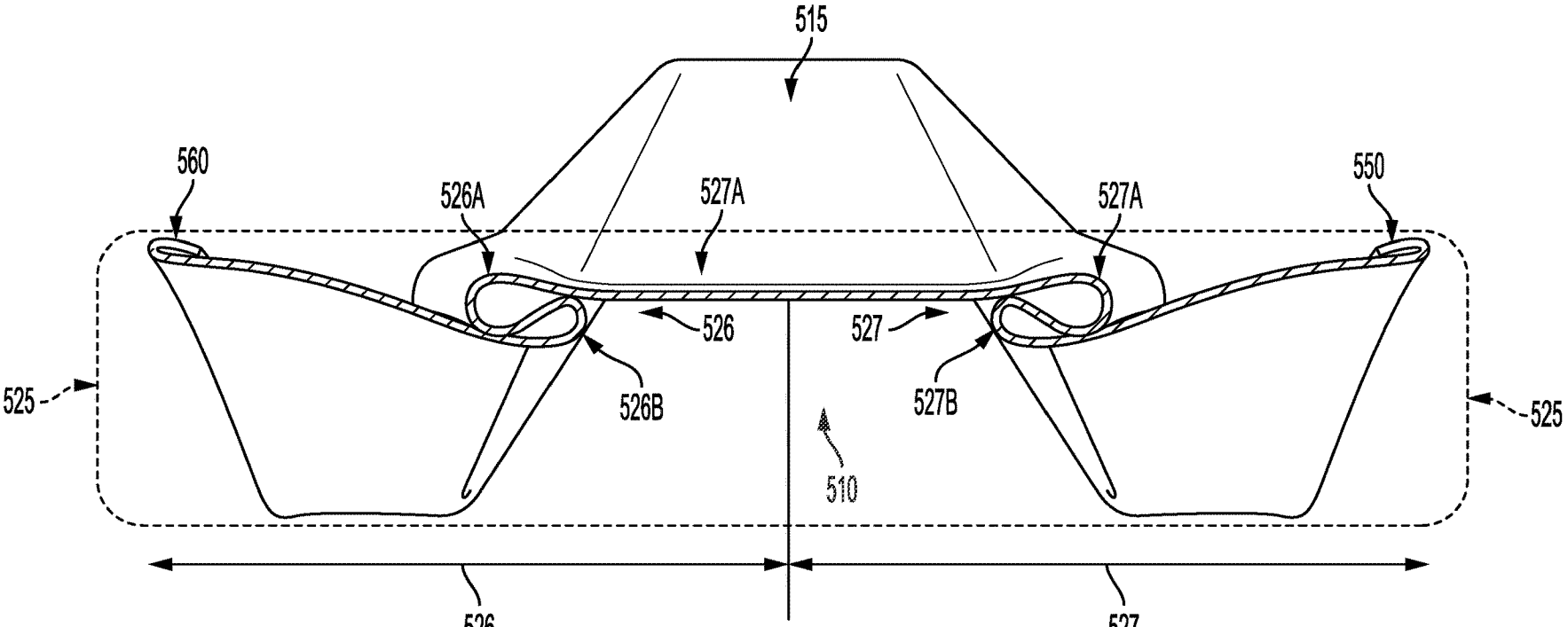
FIG. 10 is an end view of an embodiment of the invented packaging channel with the inside of the channel facing down.
Figure 11:
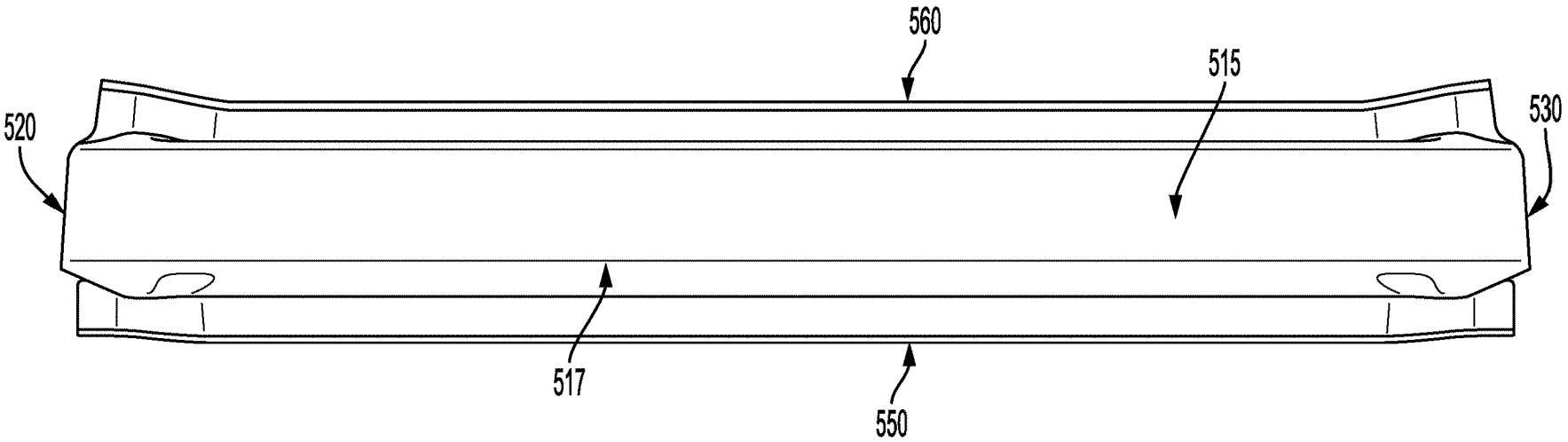
FIG. 11 is a bottom view of an embodiment of the invented packaging channel.

The bundle should preferably have at least two sets of metal packaging channels (500) each having a front side which is the channel side and a back side which is the opposite side of the channel front side and can be seen in FIGS. 10 and 11.

The bundle could also have an optional top side, and an optional bottom side with the strap or band running through additional packaging channel on the top side and the bottom side.

As explained later, the bundle may also be curved or arced, as if in packaging large pipes or tubes such as concrete sewer pipes In the depicted embodiment, the packaging channel has a length (540) running from a first end of the packaging channel (520) to a second end of the packaging channel (530) opposite of the first end.

There will also be a channel (510) open on the front side running the length (540) and formed of a packaging channel web (515) located between a first flange (516) and a second flange (517) of the metal packaging channel which are substantially perpendicular to the packaging channel web. The edge of the flange will be bent approximately 90 degrees away from the channel with a first flange rolled hem (560) at the edge of the first flange and a second flange rolled hem (550) at the edge of the second flange.

In one embodiment, the packaging channel will have a first packaging channel end (520) having a first swedge (525) and a second packaging channel end (530) having a second swedge (535).

Figure 9:
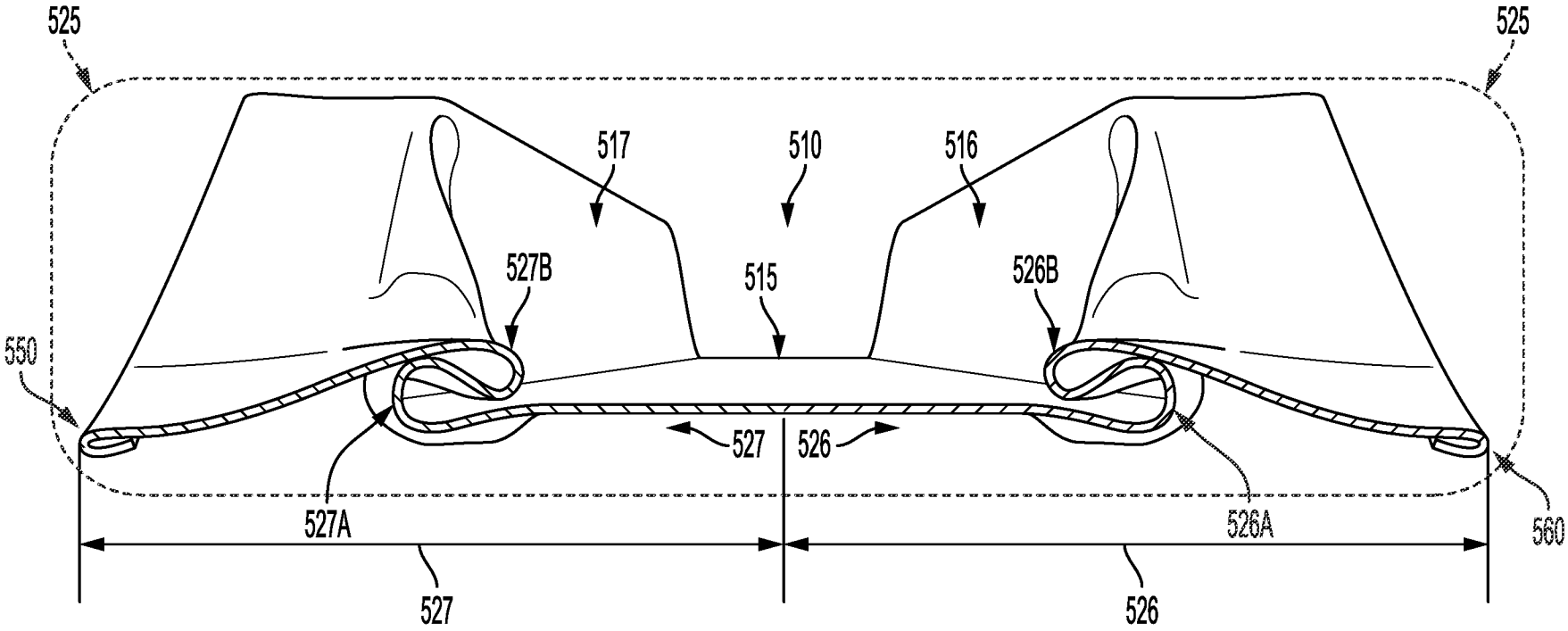
FIG. 9 is an end view of an embodiment of the invented packaging channel with the inside of the channel facing up.

The swedge can be made by smashing the end to have the profiles (526 and 527) shown in FIGS. 9 and 10.

As assembled, the bundle will have the back side of each metal packaging channel against a corresponding configuration side with a band passing around the configuration perimeter and located in each channel of the at least two metal packaging channels.

There may be channels present without straps or bands or used for a different purpose which are not part of the bundled assembly—i.e. not all channels need to be part of the strapping support.

The packaging channel can be made from an industry standard metal material such as AISI S100 and ASTM A653. One preferred embodiment of a packaging channel is a roll formed Dry Wall Furring Channel with an added rolled hem flange on each flange edge and swedged ends as shown in FIGS. 4-7.

The packaging channel is designed for stiffness and not be capable of being manually arced or bent along its length without special tooling. 0.0255" to 0.0270 thick CSB steel can be used to roll form the packaging channel.

The swedged end is further depicted in FIG. 9. Each channel end (520 and 530) will have two profiles. As shown in FIG. 9 depicting channel end (520) viewed with the channel end pointing up, the two profiles (526 and 527) each start from the center of the web and trace along the web in opposite directions with each reaching an inward curve (526A and 527A respectively), the profile then curves inward into the channel and reaches an outward curve (526B and 527B respectively), which then curves outward out of the channel, alternatively away from the channel, to the rolled hem (560 and 550 respectively).

A preferred embodiment is one where the width of the packaging channel at the end with the swedge is substantially the same as the width of the packaging channel at the center of the packaging channel without the swedge.

In another embodiment the channel is arced along at least a portion of the length of the packaging channel web away from the channel. In this manner the curved packaging channel can fit snugly against a curved bundle or curved article such as a tube, barrel, or cement sewer pipe. Alternatively, the arc can run the complete length of the web.

In a third embodiment, the packaging channel has at least one bend in the web away from the channel side. The bend is preferably perpendicular to the length. Preferred bend angles are about 30, 45, 60 and 90 degrees measured between the two arms of the angle formed by the backside of the web. In this embodiment the strap or band can be tightened at the corner of the bundle or corner of a part without the part cutting into or chafing the band.

The advantages of using bundles of this type is improved shipping stability because the metal packaging channel will not split or crack like wood. The bundle has improved strength and durability allowing for tighter banding. There will also be less shifting during transit. Additionally, the roll formed edges prevent cuts in the banding as well as prevents cuts to human hands from handing and the swedged ends prevent banding abrasion and cuts. The above advantages will reduce the number of returns and allowance from shipping damage and save on packaging costs, as well as offer a safety improvement for those handling the dunnage.

What is claimed is:

1. A packaging channel comprising: a length running from a packaging channel first end to a packaging second channel end, a channel formed by a web, a first flange and a second flange; at least a first flange rolled hem wherein the packaging channel is made of metal, a first swedged end having a first end first profile and a first end second profile, with the first end first profile starting from the center of the web and tracing along the web, reaching an inward curve, which curves into the channel, and then an outward curve which curves away from the channel to an end of the first flange; and with the first end second profile starting from the center of the web and tracing along the web in a direction opposite of the first end first profile, reaching an inward curve, which curves into the channel and then an outward curve which curves away from the channel to an end of the second flange.

2. The packaging channel of claim 1 wherein the width of the packaging channel at the first swedged end is substantially the same as the width of the packaging channel at a location which has not been swedged.

3. The packaging channel of claim 1, further comprising a second flange rolled hem (550).

4. The packaging channel of claim 3 where the width of the packaging channel at the first swedged end is substantially the same as the width of the packaging channel at a location which has not been swedged.

5. The packaging channel of claim 1, wherein the packaging channel is arced along the web for at least a portion of the length.

6. The packaging channel of claim 2, wherein the packaging channel is arced along the web for at least a portion of the length.

7. The packaging channel of claim 3, wherein the packaging channel is arced along the web for at least a portion of the length.

8. The packaging channel of claim 4, wherein the packaging channel is arced along the web for at least a portion of the length.

9. The packaging channel of claim 1, wherein the packaging channel has at least one bend in the web.

10. The packaging channel of claim 2, wherein the packaging channel has at least one bend in the web.

11. The packaging channel of claim 3, wherein the packaging channel has at least one bend in the web.

12. The packaging channel of claim 4, wherein the packaging channel has at least one bend in the web.

* * * * *